United States Patent [19]

Mirante

[11] 4,347,705

[45] Sep. 7, 1982

[54] CLOSED FLUID FLOW SYSTEM FOR PRODUCING POWER

[76] Inventor: Arthur J. Mirante, 8300 Blvd. East, North Bergen, N.J. 07047

[21] Appl. No.: 130,873

[22] Filed: Mar. 17, 1980

[51] Int. Cl.[3] ..... F01K 25/08

[52] U.S. Cl. ..... 60/651; 60/671; 60/693; 62/434

[58] Field of Search ..... 60/651, 671, 647, 648, 60/693; 62/434

[56] References Cited

U.S. PATENT DOCUMENTS 3,919,852 11/1975 Jones ..... 60/651 X 4,177,651 12/1979 McFarland ..... 60/671 X

FOREIGN PATENT DOCUMENTS 2326596 4/1977 France ..... 60/651

*Primary Examiner*—Allen M. Ostrager

*Assistant Examiner*—Stephen F. Husar

*Attorney, Agent, or Firm*—Arthur A. March

[57] ABSTRACT

Closed fluid flow system and method for producing power from an extraneous heat source, in which a receiver is maintained with a volatile heat transfer fluid medium partly in the form of liquid and partly in the form of gas, to permit the pumping of liquid therefrom by a pump to an evaporator for evaporation to gas by means of the extraneous heat source, separating of any remaining liquid residue content from such gas, compressing of the separated gas to high compression gas, expanding of the high compression gas in a prime mover to produce power, and cooling and reliquifying of the separated liquid residue content for recycling to the pump, and furthermore to permit the removing of a refrigerating control portion of the liquid from the receiver for expanding and evaporating such control portion for cooling the contents of the receiver, removing of a compensating control portion of the gas from the receiver, and compressing of the expanded and evaporated liquid control portion and of the gas control portion to low compression gas, with condensing and cooling of both the expanded gas from the prime mover and the low compression gas for return as liquid to the receiver, and with optional compression of a supplemental portion of the gas from the receiver to form additional high compression gas, the removed control portions from the receiver being sufficient to maintain in the remaining contents of the receiver an adequately cooled quantity of liquid for pumping to the evaporator.

37 Claims, 1 Drawing Figure

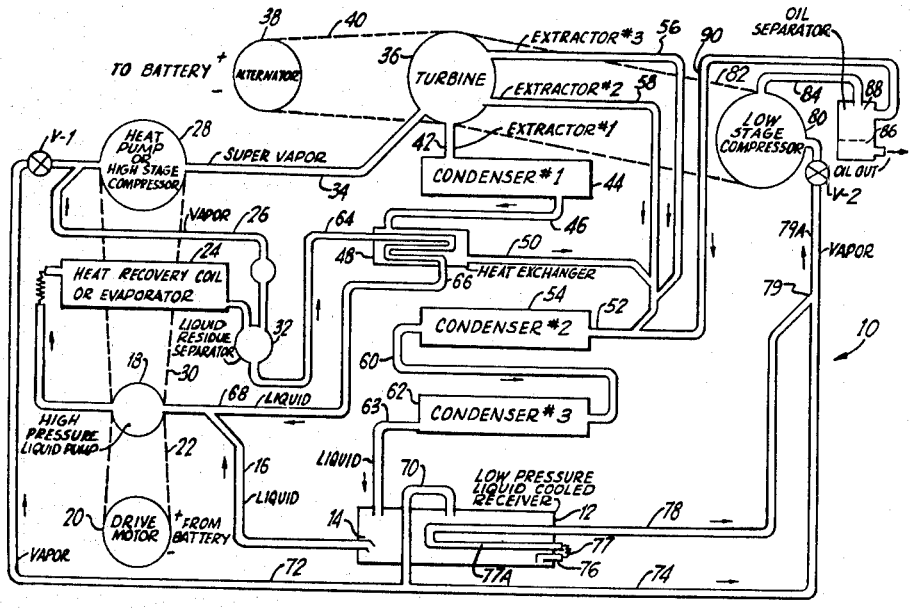

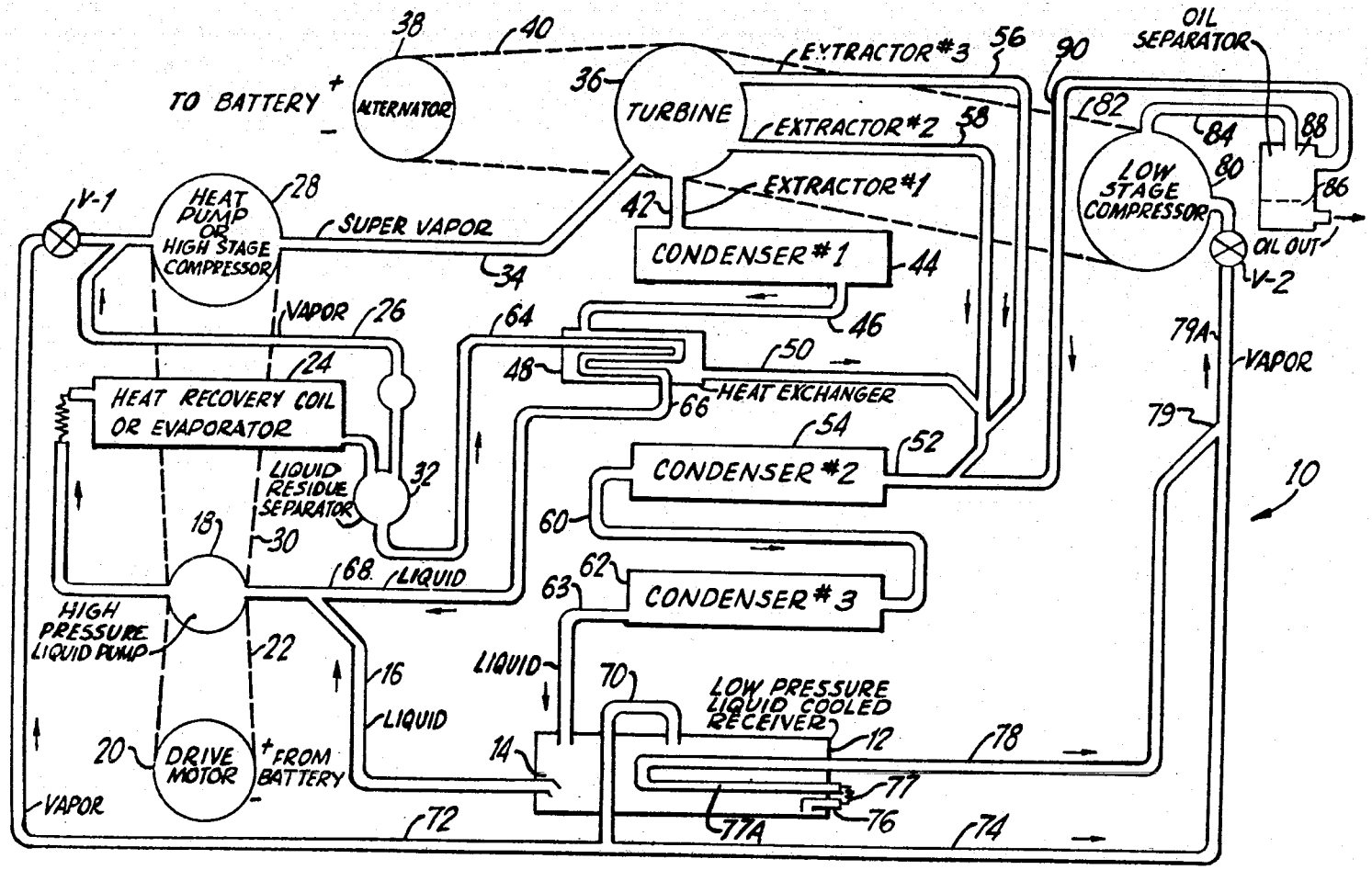
OIL SEPARATOR
OIL OUT
V-2
VAPOR
10
LOW STAGE COMPRESSOR
EXTRACTOR #3
EXTRACTOR #2
EXTRACTOR #1
TURBINE
CONDENSER #1
HEAT EXCHANGER
CONDENSER #2
CONDENSER #3
LOW PRESSURE LIQUID COOLED RECEIVER
ALTERNATOR
TO BATTERY
SUPER VAPOR
HEAT PUMP OR HIGH STAGE COMPRESSOR
V-1
VAPOR
HEAT RECOVERY COIL OR EVAPORATOR
LIQUID RESIDUE SEPARATOR
LIQUID
HIGH PRESSURE LIQUID PUMP
LIQUID
LIQUID
FROM BATTERY
DRIVE MOTOR
VAPOR

CLOSED FLUID FLOW SYSTEM FOR PRODUCING POWER

BACKGROUND OF THE INVENTION

This invention relates to a system or apparatus and a method for the efficient production of power such as electric power to motivate any type of electric motor or generator.

In the past, cycles using hydrocarbons or other fluid media as the motivating means have included turbines which have been operated by a portion of the fluid in its heated gaseous condition. In this condition, the fluid has been directed against the blades of the turbine and the turbine has been used to operate the various compressors and/or pumps for the conveying and recycling of the fluid. In such a device, the portion of the fluid which is heated to attain high pressure for the purpose of operating the turbine is generally drawn from a condenser or from a liquid receiver, then passed through an evaporator for instance having suitable heating means such as heat exchange coils, and thereafter passed to the turbine used to operate the compressors, pumps, and the like.

It has been found that the known systems described above , although having certain desirable features, may adversely affect the efficiency of the overall cycle. The reason for this is that as the turbine is operated and the portion of the fluid is drawn from the liquid receiver for evaporation in the evaporator and compression in the compressor or pump to operate the turbine, the level of the liquid available in the receiver to feed the evaporator may be reduced to the point where the evaporator is virtually starved. Furthermore, the constant drain from the receiver of the portion of the liquid to operate the turbine seriously reduces the pressure of the remaining liquid and causes undesired fluctuation of the operation of the turbine.

Certain typical patents of the prior art, which include the afore-described prior art proposals, are U.S. Pat. Nos. 1,726,462; 3,172,270; 3,315,466; 3,339,663; 3,479,817; 3,495,402; 3,511,049; and 3,636,706.

Other patents of the prior art which provide some suggestions for utilizing closed circulatory systems are for example U.S. Pat. Nos. 3,228,189; 3,990,245; 4,003,344; 4,008,573; 4,031,705; 4,063,420; 4,069,672; 4,087,974; 4,099,489; 4,120,157; and 3,292,366. In fact, U.S. Pat. No. 4,120,157 includes a vapor engine driven by the gases of a refrigerant system.

However, such systems are lacking in a two-stage fully balanced system in which the medium is introduced in liquid form; is thereafter multi-linearly directed in both liquid and gaseous form; and the work portion is converted completely into a gaseous form as the ultimate driving medium without waste or loss of the driving medium itself.

There is also lacking in the prior art a dual purpose receiver used for both the reservoir storage as well as the circulation and recirculation functioning of the driven medium.

It is most essential to provide a system which will operate continuously without fluctuation and provide enough fluid uniformly throughout the system and in the appropriate liquid and gas form, as the case may be, to avoid any possible starvation of any or all of the necessary functioning parts.

It is, therefore, among the objects and advantages of the present invention to provide a system or apparatus and a method wherein the demands upon the receiver are not interfered with and an increased efficiency of compression and turbine operation are achieved in a continuously recycling operation and in which there is virtually no loss whatsoever of the driving medium from the closed fluid flow system.

It is among the further objects and advantages of the present invention to provide a combined stage system or apparatus and corresponding method for the efficient operation of a power generating device such as can be used for any drive purposes, for example to provide replenishment of a battery or the like without waste of the driving medium.

It is among the still further objects and advantages of the present invention to provide a system or apparatus and a corresponding method that will recharge the batteries of a vehicle such as a car as it is operating or of a vehicle of any other kind as it is in motion without waste of the driving medium.

The energy provided by means affixed to a prime mover operated by the system or method such as a shaft of a turbine may be used to actuate ultimately the main drive motor of any means, such as by use of electric means to which any kind of drive may be coupled, for example by coupling the turbine to turn an alternator which will in turn recharge a battery for ultimately powering the main drive motor without waste of the driving medium.

SUMMARY OF THE INVENTION

The present invention achieves the aforesaid objects and advantages by providing a completely closed balanced fluid flow system utilizing a flowing sensible heat transfer medium or volatile fluid medium or refrigerant which changes from the liquid state into the gaseous state for efficient utilization and which is then reconverted for use into the liquid state without appreciable loss. The system includes a relatively inexpensive composite structure of readily available parts which is easy to maintain and simple to use.

The temperature and pressure parameters and change of state conditions are readily achievable without requiring the expenditure of enormous energy inputs from outside sources. The system is, in fact, able to use any available source of waste heat as the basic motivating means and ambient air and/or water as the ultimate cooling and condensing means and the complete recycling of the flowable sensible heat transfer medium is readily and efficiently accomplished.

In the basic embodiment of the invention described herein, a conventional halogenated hydrocarbon such as Freon or other inert volatilizable liquid is set forth as the sensible heat transfer medium. However, it is to be understood that any pressure fluid medium which can be converted from the liquid phase without the utilization of enormous energy input may be utilized, especially an inert volatilizable fluid medium which is non-flammable and non-explosive.

The arrangement of the present invention generally contemplates a closed fluid flow two-stage system for producing power from an extraneous heat source. In the first stage, a sufficient operable quantity of a volatile heat transfer fluid medium such as liquid Freon is introduced into and maintained within a liquid cooled receptacle or receiver serving as low pressure enclosure reservoir. The provision of this unique multi-functional receiver or reservoir as hereinafter described is an important feature of this invention.

The liquid is initially passed from the reservoir or receiver through a high pressure pump driven by independent drive means such as a drive motor or an electric motor whose power source may be a simple battery.

Next, the thus pressurized liquid passes into an evaporator in operative indirect heat exchange relation with an extraneous heat or energy supplying source such as may be provided by a heat recovery coil in the evaporator, e.g. which may be heated by the waste heat generated from the operation of a motor or by heat absorbed or collected via solar plates or any other inexpensive and easily available source of heat or energy.

The pressurized liquid passing over and into contact with the heat recovery coil is suitable expanded and substantially evaporated or vaporized and whatever portion remains as a liquid residue is separated therefrom and routed in another direction for eventual recycling to the high pressure pump via a recycle line.

The vaporized portion or resulting gas after separation from the liquid residue content is next passed through a heat pump or high stage compressor where it is converted into hot high compression gas or super vapor, preferably above its critical temperature.

The high compression gas or super vapor then passes to the second stage of the system which includes a gas operated prime mover for expanding the high compression gas to produce mechanical power, e.g. a turbine whose vanes or blades are driven by the high compression gas or super vapor as it expands, releasing its energy to drive the turbine and thereby decreasing in pressure and temperature.

The turbine is coupled by drive transmission connection means such as a pulley or the like to drive any desirable means, especially electric power generting means such as an alternator, for replenishing the battery which energizes the drive motor for the high pressure pump and heat pump.

As the turbine is activated, the thereby expanded and spent vaporous gases in the second stage are extracted or discharged from the turbine, preferably through three flow lines. One of the flow lines passes through first condenser means, e.g. a first air cooled intermediate cooler condenser and the other two flow lines lead into and pass through further condenser means, e.g. a second air cooled subcooler condenser.

In this circulating system, the separated liquid residue content from the heat recovery coil treatment described above as part of the first stage, i.e. which is routed in another direction for recycling to the high pressure pump, passes intermediately to a heat exchanger for cooling and substantially completely liquifying such liquid residue content. After passing through the heat exchanger, this thereby cooled liquid residue content is directed back or recycled to the high pressure liquid pump described above where it joins the line initially providing the liquid Freon from the receiver or reservoir and combines therewith prior to entry into the high pressure liquid pump.

The expanded and spent gaseous vapors in the second stage which flow through the first condenser thence pass in so-modified or cooler, now liquid, form via a separate pipeline through the said heat exchanger for indirect heat exchange contact with such liquid residue content, after which the same passes into the second air cooled condenser, together with the flow in the other two lines passing directly from the turbine. Hence, after passing from the heat exchanger this separate pipeline or flow line joins the other two flow lines of spent vapor emanating from the turbine and all three then are fed as a common mixed flow into the second air cooled condenser wherein the flow is changed increasingly completely to liquid state.

The resulting flow of recondensed liquid passing from the second condenser is then fed advantageously through still further condensing means, e.g. into a third condenser of similar type, where it is further cooled to the desired temperature and is returned as a sufficiently cooled completely liquid flow or phase into the reservoir or receiver which forms a part of the first stage of the system as hereinabove described.

The receiver or reservoir while receiving the liquid flow from the three condensers also contains gaseous vapors which are disposed over the liquid surface, i.e. at the top of the fluid enclosing and collecting reservoir. These vapors are removed by a gas line which branches into separate lines including a branch line returning to the heat pump described above for providing supplemental gas thereto and a relief line passing, with a separate cooling coil intake line from the receiver and serving a a refrigerating evaporator coil in the receiver, to a separate low stage compressor which is also driven by the pulley or the like activated by the aforesaid turbine.

After compression to low compression gas in the low stage compressor and optional separation of any contaminating lubricating oil in an adjoining oil separator, the pressurized gas is recondensed in the second and third condensers and then fed back to the reservoir along with the recondensed mixed flow from the heat exchanger and directly from the turbine.

While the invention hereinafter is described in detail with reference to a schematic diagram, this description is for illustrative purposes and is not to be considered a limitation upon the scope of the invention.

The drawing comprises a schematic block diagram showing the components, lines and operation of the pressure fluid system for obtaining power and energy in accordance with the present invention.

Referring to the drawing, there is shown a schematic diagram of an entire recycling system 10 for providing relatively inexpensive and usable power. As illustrated, the closed fluid flow system 10 is coupled to turn ultimately an alternator for recharging a battery. However, this form is merely for illustrative purposes and the system may be used in a variety of other functions.

The system of the present invention comprises two stages with the low pressure liquid cooled reservoir or receiver 12 forming an integral part of both stages.

In the first stage, the reservoir or receiver is provided with a sensible heat transfer medium or volatile fluid means which is shown schematically and described in the form of a liquid halogenated hydrocarbon 14 such as Freon, e.g. Freon 22, or the like. While throughout the description reference is made to this material, it is to be understood that any suitable liquid which may be converted to a pressurized vapor or gas with sufficient energy to drive the described system may be utilized, especially a medium which will not freeze under the contemplated conditions of use.

The liquid halogenated hydrocarbon, which is Freon 22 (sold under the name Genetrol 22, Allied Chemical Corp.) having a boiling point of −41.4° F., is provided in selective quantity in the reservoir 12 and is maintained therein in low pressure liquid cooled condition, e.g. at a pressure of 74 psig and a temperature of approximately 45° F. It is fed through feed lne 16 at this pressure and temperature to a high pressure liquid pump 18.

The pump 18 is driven by a suitable independent drive means such as electric motor 20 by means of pulley drive 22 shown in dotted lines or other suitable drive transmission connection means. The drive motor is powered by a battery, e.g. 12 volt battery, or any other suitable power storage means or power means.

After passing through the liquid pump 18, the halogenated hydrocarbon at an intermediate pressure and temperature, e.g. a pressure of about 115 psig and a temperature of approximately 65° F., is fed and expanded into a heat recovery coil chamber or evaporator 24 where it is converted via a heat recovery coil therein from a liquid into a gas in the usual way in an expansion and evaporator zone therein. At this point the material is exposed to a temperature of approximately from 95° to 160° F. as contributed by an extraneous energy supply source, e.g. a waste heat source such as an internal combustion engine exhaust gas or other hot exhaust gas flowing through the heat recovery coil.

Heat is thus provided in the heat recovery coil of the evaporator 24 by any suitable means. For example, the heat generated by operating any type of motor or that which is obtainable by simple solar plate structures may be utilized. In essence, this invention envisions the use of waste heat or other inexpensive energy sources for the entire conversion of the halogenated hydrocarbon or similar liquid into gaseous form as herein described and for the purposes of utilizing the primary waste heat source to run a mechanical device such as a turbine or other gas operated prime mover.

The gas then passes in vapor form from the heat recovery chamber or evaporator 24 through line 26 to a heat pump or high stage compressor 28. In this line, the gas is under a higher intermediate pressure and temperature, e.g. a pressure of approximately 132 psig and a temperature of approximately 78° F., due to the take up of energy from the waste heat source therein. The heat pump 28 is, as shown in dotted lines, driven by pulley drive 30 or other suitable drive transmission connection means which also receives its power from an independent drive means such as from the drive motor 20.

Any liquid or saturated vapor residue content from the vaporization process in the heat recovery coil chamber 24 is separated in appropriate manner from the gas content in phase separator 32 and collected and distributed for recycling in a manner hereinafter described while the gas content is fed directly to the heat pump or high stage compressor 28.

The vapor or gas passing through heat pump 28 is thus converted into a super vapor or hot high compression gas, preferably if possible or convenient for best results to above its critical temperature, and is then passed through line 34 into a gas operated prime mover such as a turbine 36. The pressure of the super vapor entering the turbine is however for instance acceptably at approximately 270 psig and the temperature is at approximately 110° F. The turbine is of the usual construction and is provided with vanes or blades which are activated by the pressure of the high compression gas or super vapor as it expands therein.

The driving of the turbine 36, which produces mechanical power, in turn, causes activation of an electric power generating means such as the alternator 38 by means of the pulley drive 40 shown in dotted lines or other suitable drive transmission connection means. The alternator 38 which may be of a 12 volt DC current variety is utilizable to recharge a battery or to provide for similar replenishment or storage of power as in any electric power storage means. Further, the turning of the turbine may, if desired, by used as the power source for any ultimate end within the confines of the power generated by these means.

Hence, the waste heat taken up via the heat recovery coil is converted into mechanical energy usable for any desired purpose through the selective control of the halogenated hydrocarbon fluid in the closed system in question.

In the first stage of the present invention, the liquid halogenated hydrocarbon is inexpensively, simply and with facility converted with minimal equipment into a vapor or gas for driving a turbine and accomplishing, at the very least, the replenishment of power through the recovery of otherwise lost waste heat.

In the second stage of the closed fluid flow system of the present invention, the means for recovery of the halogenated hydrocarbon in gaseous state and its ultimate reconversion into liquid state and maintenance in such liquid state are provided. There is normally no loss or waste of the turbine driving halogenated hydrocarbon medium itself in this regard. In this second stage, three spent gas or vapor lines emanate from the particularly provided turbine 36, suitably in a direction offset relative to the direction of and remote from the alternator 38 for best efficiency as the artisan will appreciate.

The first line (extractor #1), i.e. bottom line 42, passes from the bottom or sump portion of the turbine 36 to a condenser 44 (condenser #1) which preferably uses ambient temperature for intermediate cooling purposes, e.g. as supplied by ambient air, water or other coolant depending upon the season, climate, etc. as the artisan will appreciate. The gases emanating from the turbine 36 are in expanded condition and still under pronounced pressure although at intermediate temperature, e.g. at a pressure of approximately 155 psig and at approximately 78° F.

After passing through the pressure and temperature modifying intermediate condenser 44, the vapors which are thereby cooled and converted at least partially and preferably substantially into liquid, are fed via pipe line 46 through adjustment heat exchanger 48. At the point of entry of the recondensed liquid from condenser 44 into heat exchanger 48, the pressure thereof has been reduced to 125 psig and the temperature to approximately 74° F. After passing through heat exchanger 48, wherein the recondensed liquid from condenser 44 is expanded to produce an adjustment cooling effect, it is fed through line 50 and common line 52 into a second subcooler condenser 54 (condenser #2), which similarly uses ambient temperature for further cooling purposes.

The second and third lines 56 and 58 (extractors #3 and #2) also emanate from turbine 36 and join with passage or line 50 into common line 52 and thereby into the second condenser 54. At the point of entry into the second condenser 54, the combined portions of the halogenated hydrocarbon thereat are approximately at a pressure of 135 psig and a temperature of 76° F. After passing through the second condenser 54, the halogenated hydrocarbon combined flow is fed through line 60 into and through a third condenser 62 (condenser #3), which similarly uses ambient temperature for still further cooling purposes, after which the resultant liquid is at a pressure of approximately 120 psig and a temperature of approximately 69° F.

These condensers 44, 54 and 62 may form parts of a composite condenser means, with condensers 54 and 62 combined as one overall separate condenser if desired, and each or all such condensers may comprise air cooled means or alternatively, if desired, water or other coolant may be introduced therein for cooling purposes from any suitable source, e.g. at ambient temperature (not shown).

The halogenated hydrocarbon liquid at 120 psig and 69° F. is then returned via feed line 63 into the receiver or reservoir 12 where it is maintained at its desired pressure of 74 psig and temperature of approximately 45° F. as noted below.

The present invention therefore provides means whereby the totality of the halogenated hydrocarbon or other medium used in the system may be recoverable in liquid form and used in total balance for utmost efficiency at the various pressures and temperatures desired.

In this connection, the liquid residue content separated from the vapor or gas in the phase separator or liquid separater 32 flows through collection line 64 under a pressure of approximately 120 psig and a temperature of approximately 69° F. to the heat exchanger 48 for indirect heat exchange contact with the expanding and cooling liquid entering through pipe line 46 and which thereby serves to take up heat from the liquid residue content sufficient to liquify the same.

This so-liquified liquid residue portion after passing through heat exchanger 48 is fed through line 66 at a thereby lowered pressure of approximately 97 psig and at a corresponding lowered temperature of 52° F. to a point 68 at which this reliquified residue joins with the initial flow of liquid halogenated hydrocarbon from feed line 16 to the high pressure liquid pump 18.

Thus, the liquid residue from the heat recovery coil 24 is suitably cooled and substantially completely reliquified in heat exchanger 48 in indirect contact therein with a portion of the spent vapor exiting from the turbine 36 which has been selectively adjusted in pressure and temperature in the first condenser 44 to liquid form for selective cooling expansion therein. The so-modified or reliquified liquid residue portion may therefore be recirculated and reused in this completely closed system with full conservation thereof.

The vapors on the other hand flow via the separate gas flow line 26 from separator 32 to the heat pump 28 extending in an offset direction from the line leading to turbine 36 for compression to high compression gas to operate the turbine.

The reservoir or receiver 12 as provided, is an important facet of the present invention. It functions in both stages of the system.

The base or lower liquid sump portion of zone of the reservoir 12 is constantly kept filled with the medium, such as halogenated hydrocarbon, in liquid form via the return feed from the aforedescribed condensers.

Gases as vapors which rise to the top or upper volatile expansion gas portion or zone of the receiver 12, or which may self-generate therein under the conditions present, are fed through line 70 which branches off in two directions into branch line 72 and gas relief line 74 as shown. Branch line 72 flows supplemental gas at about 97 psig and 52° F. to the heat pump 28 as aforedescribed, joining flow line 26 containing separated gas at about 32 psig and 78° F. Gas relief line 74 flows relief gas also at about 97 psig and 52° F. to low stage compressor 80.

The liquid halogenated hydrocarbon in the unique reservoir arrangement of receiver 12 predominantly flows from the base of the reservoir through feed line 16 to the high pressure liquid pump 18 and heat recovery coil chamber or evaporator 24 and ultimately in gaseous form to the heat pump or high stage compressor 28.

In addition, the liquid halogenated hydrocarbon flows in a control portion amount outwardly from the reservoir through a standpipe 76, then through an externally disposed, e.g. ambient temperature, heat exchange capillary tube 77 and an internally disposed expansion coil 77A for expansion and refrigerant cooling purposes in indirect contact with the ingredients in reservoir 12, and thereafter through vapor line 78 to a juncture point 79 where it joins with the gaseous or vapor flow through gas relief line 74. This combined flow becomes or is substantially totally gaseous in the extension line 79A of the joined lines as it passes into and through the low stage compressor 80, and is generally approximately at 74 psig and 45° F. as it enters such low stage compressor.

The low stage compressor is driven by turbine 36 by means of a suitable drive transmission connection means such as an auxiliary low power pulley arrangement 82 and compresses the gas to form low compression gas. The flow then passes through line 84 into an optional oil separator 86 for removing lubricating oil or like contaminants entering the system, e.g. via pump 18, compressor 28, turbine 36 or compressor 80, and the vapors 88 are returned through line 90 at approximately 180 psig and 90° F. for joint flow via line 52 into condenser 54 as illustrated, for further travel through the closed system as described above.

Specifically, the portion of the continuously recycled driven medium in accordance with the present invention which is recovered from line 90 then follows the same path through condenser 54, to and through condenser 62, and ultimately via line 63 as liquid into the new and novel reservoir arrangement or receiver 12.

It will be appreciated that branch line 72 assures proper utilization of attendant regenerated gas as it boils off from the liquid content or liquid body maintained in receiver 12, by passage as supplemental gas directly to heat pump or high stage compressor 28. This aids in preventing undesired excess built up of gas in receiver 12 and in supplementing the gas supply to high stage compressor 28 especially during start up of the operation.

However, it will be appreciated that when waste heat is being supplied to the evaporator 24 the supply of gas from the phase separator 32 will normally be sufficient for efficient operation of high stage compressor 28 and turbine 36, and the total flow of gas from receiver 12 may be directed solely through gas relief branch line 74. For this purpose, a suitable adjustable control valve V-1 may be provided in supplemental gas branch line 72 to control the gas flow and selectively close off gas flow from line 72 to the high stage compressor. Valve V-1 may be adjusted for flow at constant yet adjustable intake pressure, or the like.

The phase separator 32 may be provided in the usual way, one such type being shown in the aforesaid U.S. Pat. No. 3,172,270 (Mirante), whereby to assure supply of gas to the high stage compressor 28 via gas line 26 substantially free from any remaining saturated vapor or liquid residue content which would unnessarily burden the high stage compressor and render the same less efficient.

Such U.S. Pat. No. 3,172,270 also shows an appropriate type of gas operated turbine usable herein, although the same will be suitably modified to provide for separate extractor lines as contemplated herein to permit the preferred use of a first portion of the expanded gas for heat exchange purposes in heat exchanger 48 relative to the liquid residue content separated from the gas in separator 32.

In this regard, the heat exchange modified liquid residue content from separator 32 is effectively cooled and substantially recondensed and more or less completely reliquified in heat exchanger 48 for recycling to the high pressure liquid pump 18 via the short circuit recycle line flow path through lines 64 and 66 to supplement the supply of liquid via feed line 16 to the high pressure liquid pump, especially to aid that supply during start up of the operation, while at the same time avoiding unnecessary load on the high stage compressor 28 as noted above.

By reason of the selective recovery via extractor line 42 of a first portion of the expanded gas from the turbine 36 and the selective cooling and recondensing thereof in condenser 44 to form a recondensed liquid portion, the same may be used advantageously as a modifying coolant source for absorbing heat from the liquid residue content fed via line 64 to the adjustment heat exchanger 48. The so-modified recondensed liquid portion entering heat exchanger 48 via line 46 may therefore be selectively expanded in the manner of a refrigerant into the increased interior volume represented by the expansion zone flow path thereof within the heat exchanger for indirect heat exchange contact with the liquid residue content, considering the coil zone arrangement within such heat exchanger.

Hence, as the recondensed liquid portion from line 46 expands in heat exchanger 48, it absorbs heat from the liquid residue content entering via line 64, in the manner of a refrigerating coil system, whereby to reliquify substantially completely the liquid residue content. Such expansion of the recondensed liquid portion is so carried out that its own temperature is reduced along with its pressure sufficiently to achieve cooling and reliquifying of the liquid residue content recovered via line 64 from the separator 32.

Appropriate adjustment of the quantity of expanded gas recovered via line 42 and of the extent and intensity of cooling and recondensing in condenser 44 will be undertaken, in relation to the quantity of liquid residue content flowing through line 64 and its pressure and temperature, for achieving the desired reliquifying in question, as the artisan will appreciate. Suitable adjustable valves (not shown) may be provided in lines 64, 42 and/or 46 for this purpose.

Since the effluent recondensed liquid portion leaving the heat exchanger 48 via line 50 is conveniently combined with the expanded gas flows through extractor lines 56 and 58 and with the recycling flow of low compression gas via line 90 for common feed through condensers 54 and 62, and since the three condensers may be suitably cooled by ambient air, the reliquifying of the liquid residue content will not burden the system.

Instead, its separation from the gas in separator 32 will avoid burdening of the high stage compressor 28 whereas its influence or burden on the pumping action of high pressure liquid pump 18 to repump the same will be minimal, considering its intermediate level pressure and temperature at that point. Also, any heat taken up thereby in the heat recovery coil chamber or evaporator 24 and lost in the heat exchanger 44 is of no consequence considering the relative abundancy and waste heat nature of the extraneous heat source basically utilized in the evaporator 24 to operate the system.

Except for the minor mechanical power supplied by the turbine 36 to operate the low stage compressor 80 for refrigerating the contents of the receiver 12 through the refrigerating control circuit constituted by standpipe 76, capillary tube 77 and expansion coil 77A together with flow lines 70, 74, 78, 84 and 90, the condensers 54 and 62, and return feed line 63, all of the remaining mechanical power generated in the turbine is readily converted to electric power in alternator 38.

This mechanical power converted to electric power of course exceeds that needed to operate motor 20 both for pumping liquid via feed line 16 from receiver 12 and reliquified liquid residue content via line 66 through pump 18, and for compressing the separated gas in line 26 through high stage compressor 28 to form high compression gas to operate the turbine 36.

In essence, the external or extraneous heat source being waste heat or infinite source heat relative to the closed system is expendable without real cost to the system and, apart from that heat utilized to produce work in the turbine, the rejection or removal of such heat from the system via the condensers 44, 54 and 62 is of no consequence, especially since the condensers may readily and conveniently employ expendable ambient air and/or water as abundant or infinite source coolant relative to the closed system, similarly without real cost to the system.

It will be appreciated that the receiver 12 is self-cooled in a simple and inexpensive manner by selectively removing, expanding and evaporating a comparatively minor portion of liquid therefrom via the refrigerating circuit of standpipe 76, capillary tube 77 and expansion cooling coil 77A whereby to maintain low pressure cooling therein, and by removing gas therefrom via gas relief line 74 as well as via branch line 72, not only to minimize gas build up in receiver 12 but also to remove the inherent heat content represented by such medium in regenerated gas form.

Standpipe 76 and gas line 70 are of course preferably in open flow communication with the liquid sump and gas expansion zones respectively of the receiver 12.

By reason of the external exposed and remotely disposed capillary tube 77, which is in operative indirect heat exchange contact relation with a modifying further extraneous heat source such as ambient temperature air, the liquid removed from receiver 12 via the open ended standpipe 76 is selectively preheated to adjust its temperature to attain maximal efficient expansion and evaporation in expansion cooling coil 77 A which is disposed internally within the receiver in operative indirect heat exchange contact with the interior and contents of the receiver.

Specifically, the expanded and evaporated flow via line 78 constantly removes from receiver 12 the heat content therein which is transferred in expanding and evaporating the liquid in the manner of a refrigerant in expansion cooling coil 77 A represented by such flow.

In compensating manner, the gas flow via line 70 constantly removes from receiver 12 the heat content of such gas, the portion flowing under induced suction through supplemental flow line 72 being directly used in the suction flow inducing high compression zone of the high stage compressor 28 to run the turbine 36 and that flowing under induced suction through gas relief line 74 being combined with the flow under induced suction in line 78 for compression in the suction flow inducing low compression zone of the low stage compressor 80.

For selective flow and balancing of the gas load to the high stage compressor 28 via supplemental line 72 and separately to the low stage compressor 80 via lines 74 and 79A, a further suitable adjustable control valve V-2 may be provided in line 79A. Thus, the gas flow from receiver 12 may be selectively divided or balanced as between lines 72 and 74 for constant or regulated flow via valves V-1 and V-2, as desired, and all of such flow may be optionally directed solely to low compressor 80 as appropriate, on a continuous or intermittent basis, at a constant yet adjustable intake pressure, or the like.

Hence, the low stage compressor 80 will always be adequately supplied with medium, and gas build up and pressure and temperature conditions in receiver 12 will always be correspondingly controlled.

Furthermore, any contaminant lubricating oil or the like finding its way into the system through the mechanical devices, e.g. high pressure liquid pump 18, high stage compressor 28, turbine 36, low stage compressor 80, and valves V-1 and V-2, or similar valves or devices which may also optionally be present in the closed fluid flow system, will be continuously and advantageously separated from the system via the optional oil separator 86, with convenient recycling of the oil - or other contaminant-depleted medium via line 90 and the condensers 54 and 62 to the receiver 12.

The discharge of separated oil from separator 86 will of course be controlled to assure a sufficient quantity or body of oil in the base or sump portion thereof to provide a liquid oil seal at such discharge point, as the artisan will appreciate.

Naturally, selectively controlled manual or automatic adjustable flow valves of the V-1 and V-2 type may be provided at various control points between the functional elements in the system, whereby to control the content, supply flow rate, timing of starting and stopping, etc. of the various flows through the various flow lines of the closed system in question.

Makeup fluid medium may be supplied in the well known manner to the system, e.g. via a closable port (not shown) in receiver 12, to compensate for any loss due to leakage or damage or the like, should such occur.

Normally, the content of fluid medium in the closed system is adjusted in constant quantity in terms of the total internal volume of the system and the prevailing pressure and ambient temperature when the system is static and not in operation, so as to provide an adequate reserve quantity of medium therein in liquid form permitting immediate supply upon start up of the operation of liquid to high pressure pump 18, as well as an adequate quantity of medium therein in gas form permitting immediate supply upon start up of the operation of gas to low stage compressor 80 and to high stage compressor 28 and of high compression gas to turbine 36.

Various control valves and/or check valves may be provided at approximate points along the flow lines to aid in achieving such balanced distribution of liquid and gas forms of the medium at the supply points desired, e,g. at juncture 68, at the entrance to evaporator 24, in line 34 and in line 63, and optionally in line 50, line 52, line 90 and line 84 and at juncture 79.

Normally the condensers 44, 54 and 62 are sufficient to insure during turbine operation, even at start up, that the expanded gas exiting through extractor lines 42, 56 and 58 is adequately cooled and recondensed for removing such expanded gas from the immediate vicinity of the turbine at a rate preventing accumulation of expanded gas in the turbine and in turn avoiding creation of any detrimental back pressure in the turbine.

The condensers 44, 54 and 62 as well as heat exchanger 48 may be suitably arranged for gravity induced or supplemented flow of recondensing liquid therethrough and via return feed line 63 to receiver 12 to aid in this purpose, as compared with the induced suction flow from lines 16 and 66 caused by high pressure liquid pump 18, the induced suction flow from lines 26 and 72 caused by high stage compressor 28, and the induced suction flow from lines 74 and 78 caused by low stage compressor 80.

As will be readily appreciated, the flow from line 90 may be passed through a separate condenser and return feed line back to the receiver 12, if desired, but the use of a combined flow expedient via line 52 from lines 50, 56, 58 and 90 through common tandem condensers 54 and 62, or alternatively a single composite condenser, is preferred as it is sufficient for the desired purposes.

Of course, the reduction in pressure and temperature achieved in the condensers 54 and 62 decreases the load on the low stage compressor 80 since the return feed via line 63 to the receiver is advantageously maintained at an efficiently low pressure and temperature, e.g. at 120 psig and 69° F.

The refrigerating control circuit through the low stage compressor 80 therefore need only further reduce the pressure and temperature for ongoing refrigerating maintenance of the receiver contents at the desired low pressure liquid cooled conditions, e.g. at 74 psig and 45° F.

In this regard, it will be realized that while the gas in line 74 is at 97 psig and 54° F., the quantity thereof removed from the receiver 12 is so controlled relative to the quantity of liquid removed at 74 psig and 45° F. for expansion and evaporation via line 78 that the resultant volume, pressure and temperature adjustment in mixing the two removed portions in line 79A will provide a heat containing gas flow to the low stage compressor 80 still at around 74 psig and 45° F.

In this regard, the colder the liquid supplied from the receiver 12 to the high pressure liquid pump 18 for expansion and evaporation in the manner of a refrigerant in the evaporator 24, the more heat will be able to be extracted from the extraneous heat source for ultimate conversion in the turbine to usable mechanical power, as the artisan will appreciate. As earlier noted, whereas the receiver 12 serves primarily only as a storage part of the first stage, it serves as a functioning part of the second stage.

It will be seen from the foregoing that the high pressure liquid pump 18 and the high stage compressor 28 start together upon energizing the drive motor 20 when the extraneous heat source is applied, causing immediate compression of the liquid by liquid pump 18, immediate expansion and evaporation to gas of the compressed liquid in evaporator 24 and immediate compression of the gas in high stage compressor 28, which results in instant moving of the turbine 36 and refrigerating operation of the low stage compressor 80. This is because the pump 18 and high stage compressor 28 are mechanically connected for simultaneous operation by drive motor 20 while low stage compressor 80 is mechanically connected for simultaneous operation with turbine 36, whereas turbine 36 is functionally connected with high stage compressor 28 via the high compression gas generated by the high stage compressor 28 which drives the turbine.

Optionally, of course, the use of expanded gas from the turbine which has been selectively recondensed to liquid form in condenser 44 for cooling and substantially completely reliquifying the liquid residue content from separator 32 in the heat exchanger 48, may be supplemented or replaced by other cooling means such as a portion of the liquid from receiver 12, e.g. by controlled passing of the flow of such liquid residue content into indirect heat exchange contact relation with capillary tube 77.

Thus, the liquid residue content flow from separator 32 may optionally constitute part or all of the further extraneous heat source for selectively preheating the removed liquid in capillary tube 77 and at the same time be itself selectively cooled and substantially completely reliquified for recycling to the high pressure liquid pump 18, with or without the use of such recondensed liquid portion from condenser 44.

Where such recondensed liquid portion from condenser 44 is not used, the combined flows of expanded gas from the turbine via all three lines 42, 56 and 58 simply may be passed along with the gas flow from the low stage compressor 80 through the three condensers 44, 54 and 62 in tandem series flow or cascade flow arrangement or a composite single overall condenser of adequate size may be employed for achieving the total condensing and cooling to the extent desired of the return flow to the receiver 12.

In review, essentially the refrigerating control circuit independently serves not merely to insure an adequate supply of liquid in the receiver for pumping to the evaporator, but rather also to assure that such supply of liquid will be independently adequately cooled for maximum takeup of the energy in the form of heat from the extraneous waste heat source that is fed to the evaporator. This function will normally be aided by the extent to which the condenser means cool the recondensed liquid being returned to the receiver via the return feed line 63.

However, whether ambient air and/or water or the like is used as the coolant for removing or rejecting spent heat from the recondensed liquid passing through the condenser means, and whose cooling effect will depend more or less on extraneous changeable factors such as might occur in hot or cold climates or seasons, e.g. in Florida, Maine, Alaska or Hawaii, the refrigerating control circuit will nevertheless operate independently thereof for further cooling the recondensed liquid entering the receiver through such return feed line 63 and for maintaining the balance of the liquid and gas contents in the receiver in sufficiently cooled condition to assure an adequate supply of adequately cooled liquid for maximum takeup of energy from the waste heat source in the evaporator and for maximum overall efficiency of the system or apparatus and method.

Naturally, the condenser means will be designed in such size as to provide sufficient capacity for cooling the various individual and composite flows passing therethrough to assure avoidance or minimization of any accumulation of expanded spent gas in the turbine and in turn of any detrimental back pressure therein which might detract from maximum turbine efficiency.

It should be noted that Freon 22 (Genetron 22) as used in the above described example is chlorodifluoromethane having the following published physical data: Mol. Wt. of 86.5; B.P. at 1 atm. of −41.4° F.; Freezing Pt. at 1 atm. of −256° F.; Critical Temp. of 205° F.; Critical Press. of 772 psia; Satd. Liq. Density at 86° F. of 73.3 lbs/ft$^3$; Specific Heat of Liq. at 86° F. of 0.31 BTU/lb.°F.; Specific Heat of Vapor at constant pressure at 86° F. and 1 atm. of 0.16 BTU/lb.°F.; and Specific Heat Ratio of Vapor (k=Constant Pressure/Constant Volume) at 86° F. and 1 atm. of 1.14. Typical published vapor pressures thereof (psig)/at the after-stated temperatures (°F.) are 0.5/−40; 24.0/0; 68.5/40; 76.0/45; 84.0/50; 92.6/55; 101.6/60; 111.2/65; 121.4/70; 132.2/75; 143.6/80; 155.7/85; 168.4/90; 181.8/95; 195.9/100; 210.8/105; 226.4/110; and 242.7/115 psig/°F. respectively.

It will be appreciated that the foregoing specification and accompanying drawing are set forth by way of illustration and not limitation of the present invention, and that various modifications and changes may be made therein without departing from the spirit and scope of the present invention which is to be limited solely by the scope of the appended claims.

What is claimed is:

1. Closed fluid flow system for producing power from an extraneous heat source comprising a receiver for containing volatile heat transfer fluid medium partly in the form of liquid and partly in the form of gas, a pump for pumping liquid from the receiver, an evaporator for passing the liquid from the pump in operative heat exchange relation with an extraneous heat source for evaporating the liquid to gas, a high stage compressor for compressing the gas from the evaporator to high compression gas, a gas operated prime mover for expanding the high compression gas to produce mechanical power, a refrigerating control circuit including a liquid intake line arranged for selectively removing a control portion of the liquid from the receiver and for expanding and evaporating such control portion for cooling the contents of the receiver, a gas intake line for selectively removing a compensating control portion of the gas from the receiver, and a low stage compressor for compressing the expanded and evaporated liquid from the liquid intake line and the gas from the gas intake line to low compression gas, condenser means for condensing and cooling the expanded gas from the prime mover and the low compression gas from the low stage compressor, and return feed means for returning to the receiver the resulting recondensed and cooled liquid from the condenser means.

2. System according to claim 1 wherein the prime mover is arranged for driving the low stage compressor, and independent drive means are provided for driving the pump and high stage compressor.

3. System according to claim 1 wherein a branch line is provided for feeding a selective separate supplemental portion of the gas from the receiver to the high stage compressor.

4. System according to claim 1 wherein the liquid intake line includes in series flow connection an open ended standpipe portion within the receiver for removing liquid from the interior thereof leading to an externally disposed capillary tube portion in operative heat exchange relation with a modifying heat source for preheating the removed liquid and in turn to an internally disposed expansion cooling coil portion in operative heat exchange relation with the interior and contents of the receiver for expanding and evaporating the removed liquid and thereby cooling such contents of the receiver, and a supply line portion for supplying the expanded and evaporated removed liquid from the expansion coil portion to the low stage compressor.

5. System according to claim 4 wherein the gas intake line is flow connected to the supply line portion of the liquid intake line for common feed of the expanded and evaporated removed liquid and the removed gas to the low stage compressor.

6. System according to claim 1 wherein a separator is provided for separating any remaining liquid residue content from the gas formed in the evaporator, a recycle line for returning the liquid residue content back to the pump, and heat exchange means in the recycle line for cooling and substantially completely liquifying such liquid residue content before return thereof to the pump.

7. System according to claim 6 wherein the condenser means includes a separate condenser for condensing and cooling a selective modifying portion of the expanded gas from the prime mover to form a modifying coolant source, and flow line means are provided for passing such modifying coolant source to the heat exchange means and into operative heat exchange relation with the liquid residue content and thereafter to the remainder of the condenser means for further cooling and in turn via the return feed means back to the receiver.

8. Closed fluid flow system according to claim 1 for producing power from an extraneous heat source comprising a receiver having a lower sump zone and an upper expansion zone for containing a volatile heat transfer fluid medium partly in the form of liquid and partly in the form of gas, a high pressure liquid pump for pumping liquid from the receiver, an evaporator having an expansion zone for passing the liquid from the pump in operative heat exchange relation with an extraneous heat source for expanding and evaporating the liquid to gas having a liquid residue content, a phase separator for separating the liquid residue content from the gas formed in the evaporator, a recycle line providing a flow path for returning the liquid residue content back to the pump, a heat pump constituted high stage compressor for compressing the gas from the separator to high compression gas, a gas operated mechanical power generating prime mover for expanding the high compression gas to produce mechanical power, first condenser means for condensing and cooling a first portion of the expanded gas from the prime mover to a first recondensed liquid portion, adjustment heat exchange means for passing and selectively expanding the first recondensed liquid portion in operative heat exchange relation with the liquid residue content in the recycle line flow path for cooling and substantially completely liquifying such liquid residue content before return thereof to the pump, a refrigerating liquid and gas operated control circuit including a liquid cooling coil intake line extending within the receiver and arranged for selectively removing a control portion of the liquid from the receiver and for expanding and evaporating such control portion within the cooling coil line for cooling the interior and contents of the receiver, a gas relief intake line for selectively removing a compensating control portion of the gas from the receiver for relieving the gas contents thereof, and a low stage compressor arranged for common operation with the prime mover for compressing the expanded and evaporated liquid from the cooling coil line and the gas from the relief line to provide a combined control portion low compression gas, further condenser means for further cooling the first recondensed liquid portion from the adjustment heat exchange means, for condensing and cooling the remaining portion of the expanded gas from the prime mover, and for condensing and cooling the low compression gas from the low stage compressor, and return feed flow line means for returning to the receiver the condensed and cooled liquid from the further condenser means.

9. System according to claim 8 wherein drive transmission connection means are provided for operatively interconnecting the prime mover with the low stage compressor for driving the low stage compressor, and independent drive means are provided for driving the pump and high stage compressor.

10. System according to claim 9 wherein electric power generating means are provided in operative drive transmission connection with the prime mover for converting the remaining mechanical power of the prime mover to electric power for storage in electric power storage means.

11. System according to claim 10 wherein the independent drive means includes an electric motor arranged for energization by electric power correspondingly provided by a portion of the electric power generated by the electric power generating means for storage in the electric power storage means.

12. System according to claim 11 wherein the prime mover is a turbine, the electric power generating means is an alternator, and the turbine is in operative drive transmission connection with both the low stage compressor and the alternator, and wherein the electric motor is in operative drive transmission connection with both the pump and high stage compressor.

13. System according to claim 8 wherein a branch feed line is provided for feeding a selective separate supplemental portion of the gas from the receiver to the high stage compressor for compression with the gas from the separator.

14. System according to claim 8 wherein the cooling coil intake line includes in series flow connection an open ended standpipe portion within the receiver for removing liquid from the interior thereof leading to an externally disposed heat exchange capillary tube portion in operative heat exchange relation with a modifying further extraneous heat source for preheating the removed liquid and in turn to an internally disposed refrigerating expansion coil portion in operative heat exchange relation with the interior and contents of the receiver for expanding and evaporating the removed liquid and thereby cooling such interior and contents of the receiver, and a supply line portion for supplying the expanded and evaporated removed liquid from the expansion coil portion to the low stage compressor.

15. System according to claim 14 wherein the gas relief line is flow connected to the supply line portion of the cooling coil intake line for common feed of the expanded and evaporated removed liquid and the removed gas to the low stage compressor.

16. System according to claim 8 wherein extractor line means are provided for conveying the remaining portion of the expanded gas from the prime mover to the further condenser means, and first recondensed liquid line means are provided for conveying the first recondensed liquid portion from the adjustment heat exchanger means, said first recondensed liquid line means being flow connected to the extractor line means for common feed of the first recondensed liquid portion and the remaining portion of the expanded gas to the further condenser means.

17. System according to claim 16 wherein a low compression gas line means is provided for conveying the low compression gas from the low stage compressor to the further condenser means, said low compression gas line means being flow connected to the extractor line means for common feed with the first recondensed liquid portion and the remaining portion of the expanded gas to the further condenser means and in turn via the return feed means for common flow thereof back to the receiver.

18. Method of operating a closed fluid flow system for producing power from an extraneous heat source comprising maintaining in a receiver a volatile heat transfer fluid medium partly in the form of liquid and partly in the form of gas, pumping liquid from the receiver to an evaporator and into operative heat exchange relation with an extraneous heat source provided therein for substantially evaporating the liquid to gas, compressing the gas formed in the evaporator to selective high compression gas, expanding the high compression gas in a prime mover to produce mechanical power, removing a selective refrigerating control portion of the liquid from the receiver and expanding and substantially evaporating such control portion in operative heat exchange relation with the contents of the receiver for cooling the contents of the receiver, removing a selective compensating control portion of the gas from the receiver, compressing the expanded and substantially evaporated liquid control portion and the gas control portion to selective low compression gas, and condensing and selectively cooling the expanded gas from the prime mover and the low compression gas, and returning to the receiver the resulting recondensed liquid, the removed control portions from the receiver being sufficient to maintain in the remaining contents of the receiver an adequately cooled quantity of liquid for pumping to the evaporator.

19. Method according to claim 18 wherein a selective separate supplemental portion of the gas is removed from the receiver and compressed to selective high compression gas for expanding in the prime mover.

20. Method according to claim 18 wherein the control portion of the liquid removed from the receiver is passed into operative heat exchange relation with a modifying heat source remote from the receiver for selectively preheating the liquid control portion prior to expanding and substantially evaporating such control portion in heat exchange relation with the contents of the receiver.

21. Method according to claim 18 wherein any remaining liquid residue content is separated substantially from the gas formed in the evaporating, the separated liquid residue content is recovered for recycling, the recovered liquid residue content is cooled and substantially completely liquified, and the liquified residue content is recycled for pumping to the evaporator.

22. Method according to claim 21 wherein a selective modifying portion of the expanded gas from the prime mover is condensed to form a modifying coolant source, and such modifying coolant source is passed into operative heat exchange relation with the recovered liquid residue content for cooling and substantially completely liquifying such liquid residue content and is thereafter further cooled and returned as resulting recondensed liquid to the receiver.

23. Method of operating a closed fluid flow system according to claim 18 for producing power from an extraneous heat source comprising maintaining in a receiver having a lower sump zone and an upper expansion zone a volatile heat transfer fluid medium partly in the form of liquid and partly in the form of gas, pumping liquid from the receiver under pumping pressure to an evaporator having an expansion zone and into operative heat exchange relation with an extraneous heat source provided therein for substantially expanding and evaporating the liquid to gas having a remaining liquid residue content, separating in a phase separator the fluid residue content substantially from the gas formed in the evaporating and recovering the liquid residue content for recycling, compressing the separated gas to selective high compression hot gas, expanding the high compression gas in a mechanical power generating prime mover to produce mechanical power, condensing and selectively cooling a first portion of the expanded gas from the prime mover to provide a first recondensed liquid portion, passing the first recondensed liquid portion into operative heat exchange relation with the recovered liquid residue content for cooling and substantially completely liquifying such liquid residue content and recycling the liquified residue content for combining with the liquid from the receiver being pumped to the evaporator, the condensing and selective cooling of the first portion of the expanded gas being sufficient for the resulting first recondensed liquid portion to cool and substantially completely liquify the recovered liquid residue content prior to recycling thereof, removing a selective refrigerating control portion of the liquid from the receiver sump zone and expanding and substantially evaporating such control portion in operative heat exchange relation with the contents of the receiver for cooling the interior and contents of the receiver, removing a selective compensating control portion of the gas from the receiver expansion zone for relieving the gas contents of the receiver, compressing in a low compression zone the expanded and substantially evaporated liquid control portion and the gas control portion to selective low compression gas, further selectively cooling the first recondensed liquid portion after passage in heat exchange relation with the recovered liquid residue content, condensing and selectively cooling the remaining portion of the expanded gas from the prime mover to provide a remaining recondensed liquid portion, condensing and selectively cooling the low compression gas to provide a recondensed liquid control portion, and returning to the receiver the further cooled first recondensed liquid portion, the remaining recondensed liquid portion, and the recondensed liquid control portion, the removed control portions from the receiver being sufficient to maintain in substantial balance in the remaining contents of the receiver an adequately cooled quantity of liquid for pumping to the evaporator and for providing in turn an adequate quantity of high compression gas for producing mechanical power in the prime mover in excess of that power required for compressing the control portions to low compression gas, for pumping the liquid from the receiver to the evaporator and for compressing the separated gas to high compression gas.

24. Method according to claim 23 wherein sufficient fluid medium is included in the closed fluid flow system for maintaining an adequate quantity thereof in the form of liquid in the closed system under external ambient temperature during static periods when the method is not being operated to permit the starting of the operation of the method with an immediate supply of liquid from the receiver both for pumping to the evaporator and for removing a control portion for expanding and substantially evaporating such control portion and correspondingly with an immediate counterpart supply of gas both from the receiver for removing such compensating control portion and from the compressing to high compression gas for expanding in the prime mover.

25. Method according to claim 24 wherein a selective separate supplemental portion of the gas is removed from the receiver and compressed with the separated gas to selective high compression gas, and such counterpart supply of gas from the receiver includes such separate supplemental portion for compressing to high compression gas for expanding in the prime mover.

26. Method according to claim 25 wherein the gas portions removed from the receiver both for compressing to high compression gas and for compressing to low compression gas and the liquid control portion removed from the receiver for expanding and substantially evaporating are correspondingly sufficient for further cooling in the receiver the first recondensed liquid portion, the remaining recondensed liquid portion and the recondensed liquid control portion returned to the receiver and for maintaining in substantial balance in the remaining contents of the receiver such adequately cooled quantity of liquid.

27. Method according to claim 23 wherein a selective separate supplemental portion of the gas is removed from the receiver and compressed to selective high compression gas for expanding in the prime mover.

28. Method according to claim 27 wherein the gas portions removed from the receiver both for compressing to high compression gas and for compressing to low compression gas and the liquid control portion removed from the receiver for expanding and substantially evaporating are correspondingly sufficient for further cooling in the receiver the first recondensed liquid portion, the remaining recondensed liquid portion and the recondensed liquid control portion returned to the receiver and for maintaining the remaining contents of the receiver partly in the form of a liquid which is further cooled relative to the recondensed liquid portions being returned to the receiver.

29. Method according to claim 28 wherein sufficient fluid medium is included in the closed fluid flow system for maintaining an adequate quantity thereof in the form of a liquid in the closed system under external ambient temperature during static periods when the method is not being operated to permit the starting of the operation of the method with an immediate supply of liquid from the receiver both for pumping to the evaporator and for removing a control portion for expanding and substantially evaporating such control portion and correspondingly with an immediate counterpart supply of gas both from the receiver for removing such compensating control portion and such separate supplemental portion and from the compressing to high compression gas for expanding in the prime mover.

30. Method according to claim 23 wherein the condensing and selective cooling of the first and remaining portions of the expanded gas from the prime mover are sufficient for removing such expanded gas from the immediate vicinity of the prime mover at a rate substantially preventing accumulation of expanded gas in the prime mover and in turn substantially avoiding the creating of back pressure in the prime mover.

31. Method according to claim 23 wherein the condensing and selective cooling of the first and remaining portions of the expanded gas from the prime mover and of the low compression gas are carried out in operative heat exchange relation with an ambient coolant.

32. Method according to claim 31 wherein such ambient coolant is ambient air.

33. Method according to claim 23 wherein the extraneous heat source is a waste heat source.

34. Method according to claim 23 wherein a portion of the produced mechanical power is used for compressing both the expanded and substantially evaporated liquid control portion and the gas control portion to low compression gas and the remainder of such mechanical power is converted to storable electric power, and a portion of such electric power is reconverted to mechanical power for pumping the liquid from the receiver to the evaporator and for compressing the separated gas to high compression gas.

35. Method according to claim 34 wherein the compressing to low compression gas, conversion to storable electric power, reconversion to mechanical power, pumping of the liquid to the evaporator and compressing to low compression gas are started and carried out simultaneously upon providing the evaporator with the extraneous heat source.

36. Method according to claim 23 wherein the control portion of the liquid removed from the receiver is passed into operative heat exchange relation with a modifying further extraneous heat source remote from the receiver for selectively preheating the liquid control portion prior to expanding and substantially evaporating such control portion in heat exchange relation with the contents of the receiver.

37. Method according to claim 36 wherein the modifying further extraneous heat source is ambient air.

* * * * *